US005483030A

United States Patent [19]

Bridges

[11] Patent Number: 5,483,030

[45] Date of Patent: Jan. 9, 1996

[54] GROUP OPERATED CIRCUIT DISCONNECT APPARATUS FOR OVERHEAD ELECTRIC POWER LINES

[76] Inventor: Ronald P. Bridges, 851 Rock Ledge Rd., Heber Springs, Ark. 72543

[21] Appl. No.: 240,237

[22] Filed: May 10, 1994

[51] Int. Cl.[6] ..... H01H 33/12; H01H 9/38; H01H 31/00

[52] U.S. Cl. ..... 218/12; 200/48 KB; 200/48 R; 218/14; 218/20

[58] Field of Search ..... 200/48 R, 48 A, 200/48 CB, 48 KB, 48 SB, 48 P, 48 V, 49, 146 R, 146 A, 146 AA, 50 C, 79; 218/1, 2, 8, 9, 12, 14, 20, 154, 155; 307/126, 139; 174/45 R

[56] References Cited

U.S. PATENT DOCUMENTS

| | | | |
|---|---|---|---|
| Re. 30,784 | 10/1981 | Bridges | 200/48 KB |
| 3,205,330 | 9/1965 | Bridges | 218/12 |
| 4,013,852 | 3/1977 | Roberts et al. | 218/12 |
| 4,095,061 | 6/1978 | Bridges | 200/48 KB |
| 4,184,059 | 1/1980 | Graham et al. | 200/302.1 |
| 4,654,540 | 3/1987 | Bridges | 307/126 |
| 5,091,616 | 2/1992 | Ramos et al. | 218/9 |

OTHER PUBLICATIONS

"S & C Omni–Rupter® Switches Outdoor Distribution (14.4 kv and 25 kv)", S & C Electric Company Descriptive Bulletin 765–30 (May 21, 1990).

"Chance Type S Switch Your Choice of Switches", A. B. Chance Co. Bulletin 14–9002 (1990).

*Primary Examiner*—J. R. Scott

*Attorney, Agent, or Firm*—Wood, Phillips, VanSanten, Clark & Mortimer

[57] ABSTRACT

A group operated switching apparatus for overhead electric power lines has a box-like elongated housing which mounts on a pole and supports three disconnect switches. Three operating shafts are journalled on the housing and are operatively connected to the disconnect switches so that axial rotation of the operating shafts alternately opens and closes the disconnect switches. An upright control shaft extends through the housing. A transverse rod assembly is enclosed within the housing and defines a mechanical connection between the control shaft and the operating shafts so that axial rotation of the control shaft causes axial rotation of the operating shafts. Each disconnect switch includes a jaw terminal having dual function backup springs and auxiliary contacts for minimizing effects of arcing during opening and closing of the switch.

37 Claims, 12 Drawing Sheets

44
56
80
16
10
104
4
98
56
5
80
42
56
80
44

68
70
82
64
62
25
70
68
4
114
66
66
68
5
70
82
62
64
70
68
82

80
92
42
88
72
38
64
74
68
46
40
76
86
90
94
96
84
90
30
48
72
38
64
74
78
56

68
64
115
42
112
72
74
68
40
106
108
110
104
24
118
104
116
102
100
98
118
54
112
72
64
74
120
52

Fig. 15
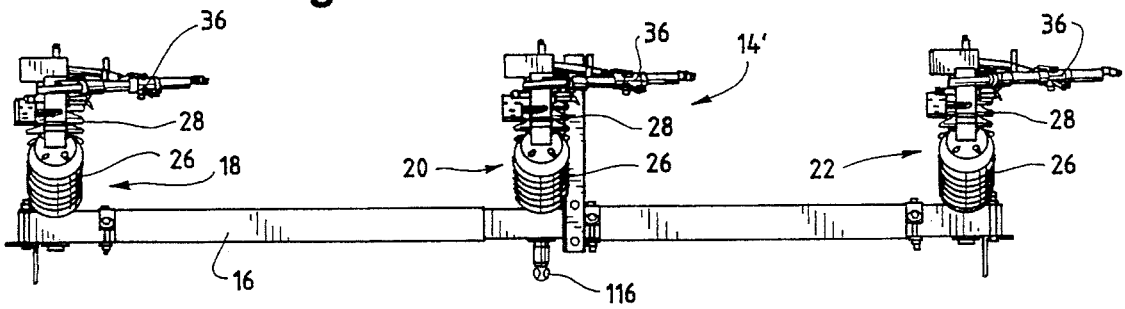
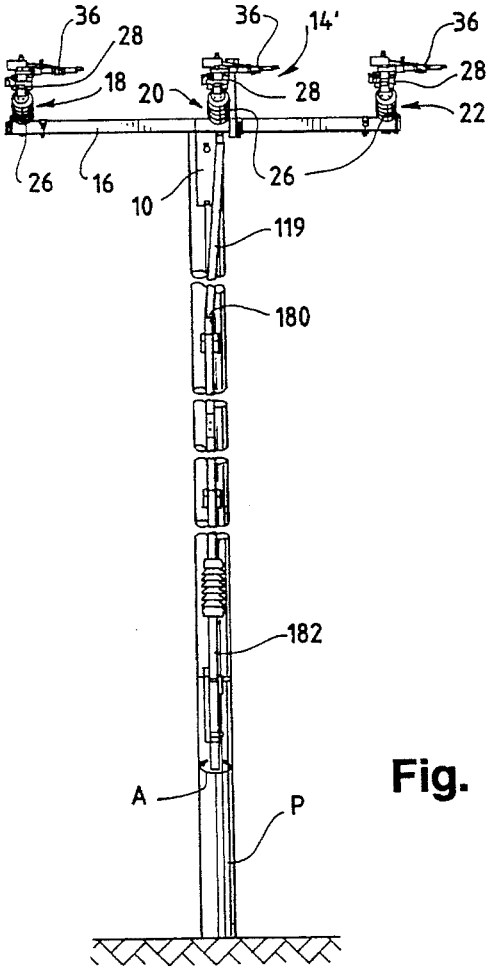
Fig. 14
Fig. 13
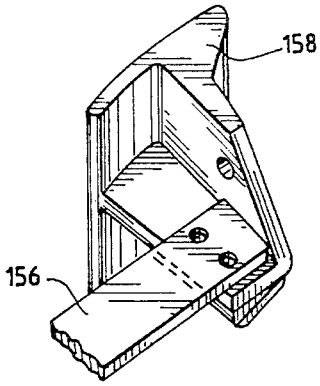

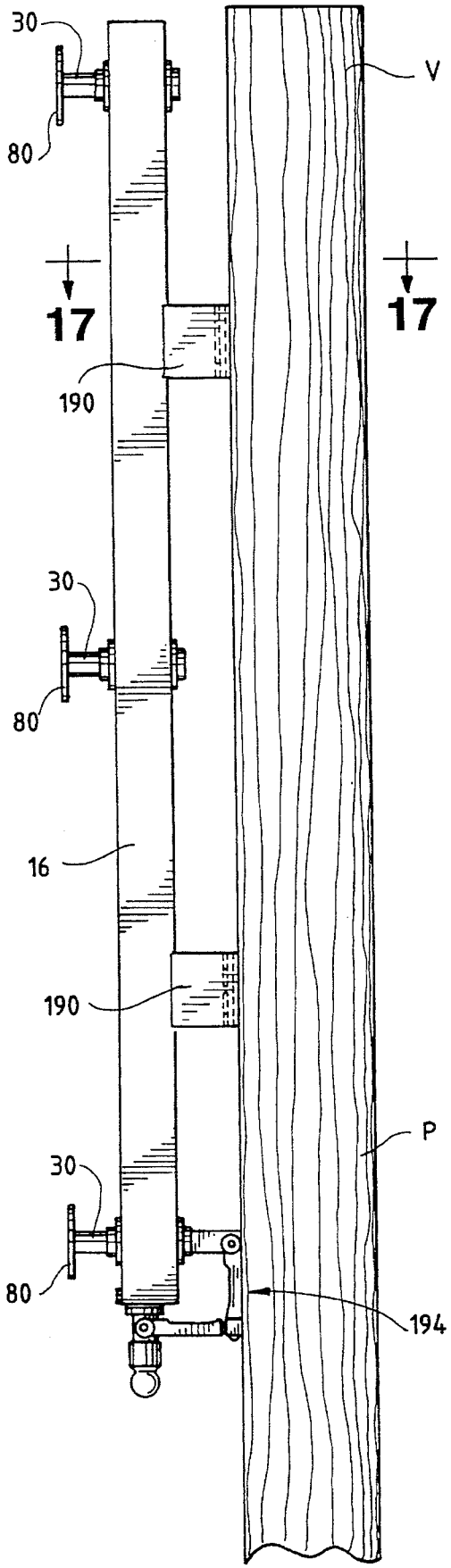
Fig. 16
Fig. 17
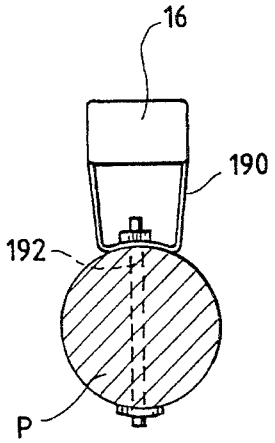

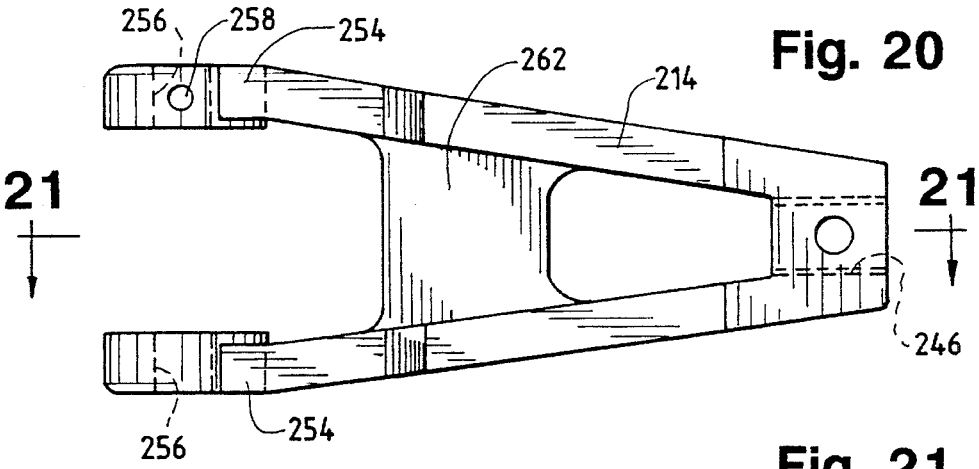
Fig. 20
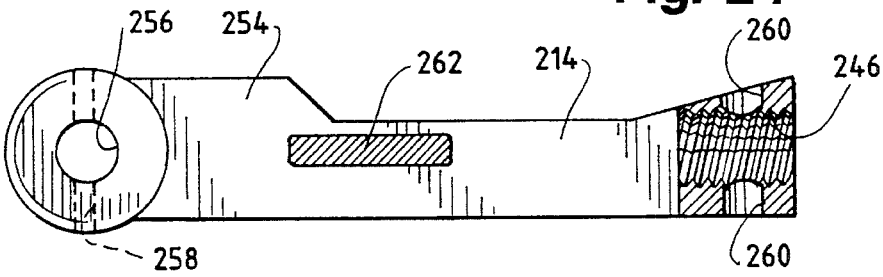
Fig. 21
Fig. 22
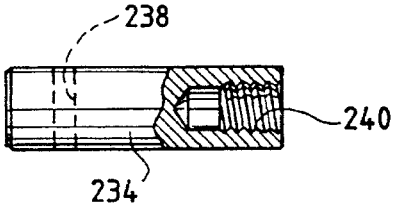
Fig. 23
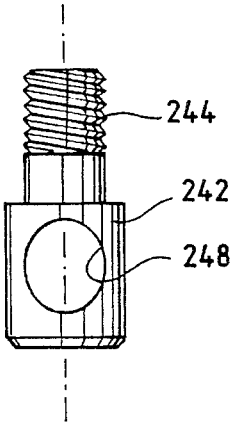
Fig. 24
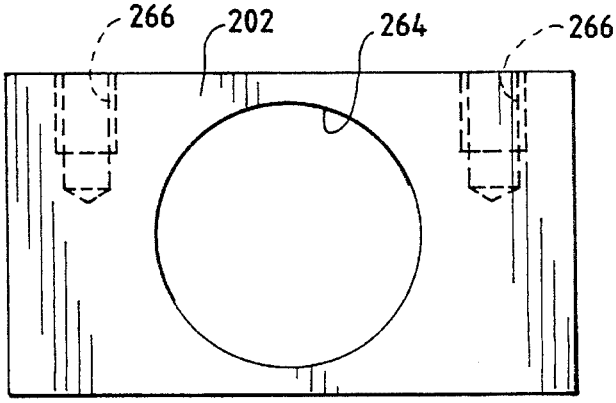

GROUP OPERATED CIRCUIT DISCONNECT APPARATUS FOR OVERHEAD ELECTRIC POWER LINES

BACKGROUND OF THE INVENTION

1. Technical Field

This invention generally relates to electric circuit apparatus and, more particularly, to group operated circuit disconnect apparatus for overhead electric power distribution lines carried on poles.

2. Background Art

Overhead electric power distribution lines are mounted upon poles by a wide variety of mounting structures. The poles may be 40–50 feet high and the mounting means often carry various distribution apparatus. For instance, the distribution lines require circuit disconnect means at certain locations. Since such distribution lines commonly operate in a three-phase system, there are three associated lines which ordinarily must be disconnected and reconnected simultaneously. This requires group operated switches. Support structures also are mounted intermediate or down on the pole for distribution at certain locations to various facilities remote from the main power line.

One problem with prior art group operated circuit disconnect devices is that such apparatus can have rotatable or sliding parts which are exposed to the weather where they may become corroded, or where they may become immobilized in the winter because of ice formed on the parts. Exposed components of a disconnect device cannot be easily insulated and, in addition, are often aesthetically undesirable.

Another problem with existing group operated circuit disconnect devices is that such apparatus typically have a plurality of disconnect switches, each switch having a rotatable switch blade receivable in a single set of jaw contacts for closing a circuit. As a result of the high voltage with which such devices are used, pre-arcing between the switch blade and the jaw contacts during switch closing can cause severe damage to or even destroy the contacts. Particularly, when a switch is closed into a faulted circuit, arcing can render the blade incapable of carrying its full rated load current.

This invention is directed to solving these problems by providing a new and improved group operated switching apparatus including a support structure for mounting the distribution lines on a pole, the structure being efficient and inexpensive to manufacture, yet providing improved performance not heretofore available.

SUMMARY OF THE INVENTION

An object of the present invention, therefore, is to provide a new and improved group operated circuit disconnect apparatus for overhead electric power distribution lines carried on poles.

In the exemplary embodiment of the invention, a group operated switching apparatus for overhead electric power lines includes a box-like housing which mounts on a pole and supports three disconnect switches. Three upright operating shafts are journalled on the housing and are operatively connected to the disconnect switches so that axial rotation of the operating shafts alternately opens and closes the disconnect switches. An upright control shaft extends through the housing. A transverse rod assembly is enclosed within the housing and defines a mechanical connection between the control shaft and the operating shafts so that axial translation of the control shaft causes axial rotation of the operating shafts. Each disconnect switch includes a jaw terminal having dual function backup springs and auxiliary contacts for minimizing effects of arcing during opening and closing of the switch.

The housing has top and bottom walls and side walls. The upright shafts penetrate the top and bottom walls and are supported thereon for rotation about mutually parallel axes located in a common vertical plane. The operating rod and mechanical connection are located entirely within the housing. Seals are positioned around the upright shafts at the top wall to prevent moisture from entering the housing.

In the exemplary embodiment, the mechanical connection consists of a crank fixed to the upright shafts and pivoted to the operating rod. The operating rod includes a pair of elongated members having a hollow threaded fitting and a threaded stem screwed into the fitting so the length of the operating rod can be adjusted.

An operating shaft is journalled on the base and has a mechanical connection with the operating rod so that axial rotation of the operating shaft causes axial translation of the operating rod inside the housing. The upright shafts have their axes substantially parallel to and in the same vertical plane with the axis of the operating shaft. A stop sleeve is mounted on the operating shaft to limit rotation of the operating shaft.

In the preferred embodiment of the invention, a substantially non-insulating material, such as plastic, covers the housing. A pair of spaced apart end walls restrict access to the interior of the housing.

Each switch has a rotatable element supported on one of the upright shafts with a switch blade mounted on the rotatable element. The base has a plurality of supports inclined relative to the upright shafts for supporting a fixed element of a disconnect switch at an acute angle relative to the rotatable element of a disconnect switch.

More specifically, each switch has a rotatable element supported on a control shaft and a switch blade mounted on the rotatable element. A hinge contact is provided along the axis of the rotatable element for electrically connecting a power line to the disconnect switches so that the hinge contact remains substantially stationary when the switch blade rotates. Each switch further includes a jaw terminal for receiving the free end of the switch blade upon pivoting of the blade between a position engaged with the terminal and a fully open position. The jaw terminal has a first pair of electrical contacts for receiving the switch blade therebetween, backup springs adjacent outer surfaces of the first contacts for urging the first contacts toward each other, and a second pair of auxiliary electrical contacts integral with the backup springs for making electrical contact with the switch blade without the switch blade making electrical contact with the first contacts. In the exemplary embodiment the auxiliary contacts are made of phosphor bronze.

The present invention also contemplates a method of assembling a group operated electric circuit disconnect apparatus. Specifically, the method includes the step of providing a plurality of spaced apart through openings in a box-like housing and inserting stub shafts through the openings during assembly so that the stub shafts extend outside of the housing. The operating rod then is positioned adjacent the housing exterior. A plurality of cranks are provided for operatively connecting the upright shafts to the operating rod when the apparatus is assembled. The cranks have an opening for receiving the upright shafts in a predetermined angular relationship therewith. The cranks are aligned in the predetermined angular relationship with the stub shafts outside the housing and pivotally connected to the operating rod. The stub shafts then are removed from the housing and crank openings. The assembled operating rod and cranks then are inserted lengthwise into the housing so that the crank openings are aligned with the housing openings and the upright shafts can be inserted through the housing and crank openings to operatively connect the upright shafts and the operating rod.

Further, the method of assembly includes the step of providing a through opening in the housing for receiving an operating shaft. A crank is provided for operatively connecting the operating shaft to the operating rod when the apparatus is assembled and has an opening with a keyway for receiving the operating shaft in a predetermined angular relationship therewith. The link is aligned in a predetermined angular relationship with a stub shaft outside the housing and pivotally connected to the operating rod.

Moreover, the invention contemplates that the operating rod is lengthwise adjustable. The disclosed method also comprises the step of adjusting the length of the operating rod while the rod is outside the housing so that the locations at which the cranks pivotally connect to the operating rod are longitudinally aligned with the stub shafts during assembly.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

FIG. 13 is a broken, perspective view of the blade end and contactor support;

FIG. 14 is a side elevational view of another embodiment of a group operated circuit disconnect apparatus similar to that of FIGS. 1–13, but with the three disconnect switches being more "symmetrical" at the top of the pole;

FIG. 15 is a side elevational view of the apparatus at the top of the pole in FIG. 14;

FIG. 16 is a side elevational view of still another embodiment of a group operated circuit disconnect apparatus mounted in a vertical orientation at the top of the pole, the disconnect switches, themselves, being removed to facilitate the illustration;

FIG. 17 is a horizontal section taken generally along line 17—17 of FIG. 16;

FIG. 20 is a side elevational view of one of the crank arms;

FIG. 21 is a horizontal section taken generally along line 21—21 of FIG. 20;

FIG. 22 is a fragmented section through the pivot post within the end of the horizontal crank arm shown in FIGS. 18 and 19;

FIG. 23 is an elevational view of the swivel mounted in the end of the vertical crank arm in FIGS. 18 and 19; and FIG. 24 is a plan view of the block that rotatably mounts the operating shaft of the rotary operating mechanism shown in FIGS. 18 and 19.

DETAILED DESCRIPTION OF THE INVENTION

Figure 1:
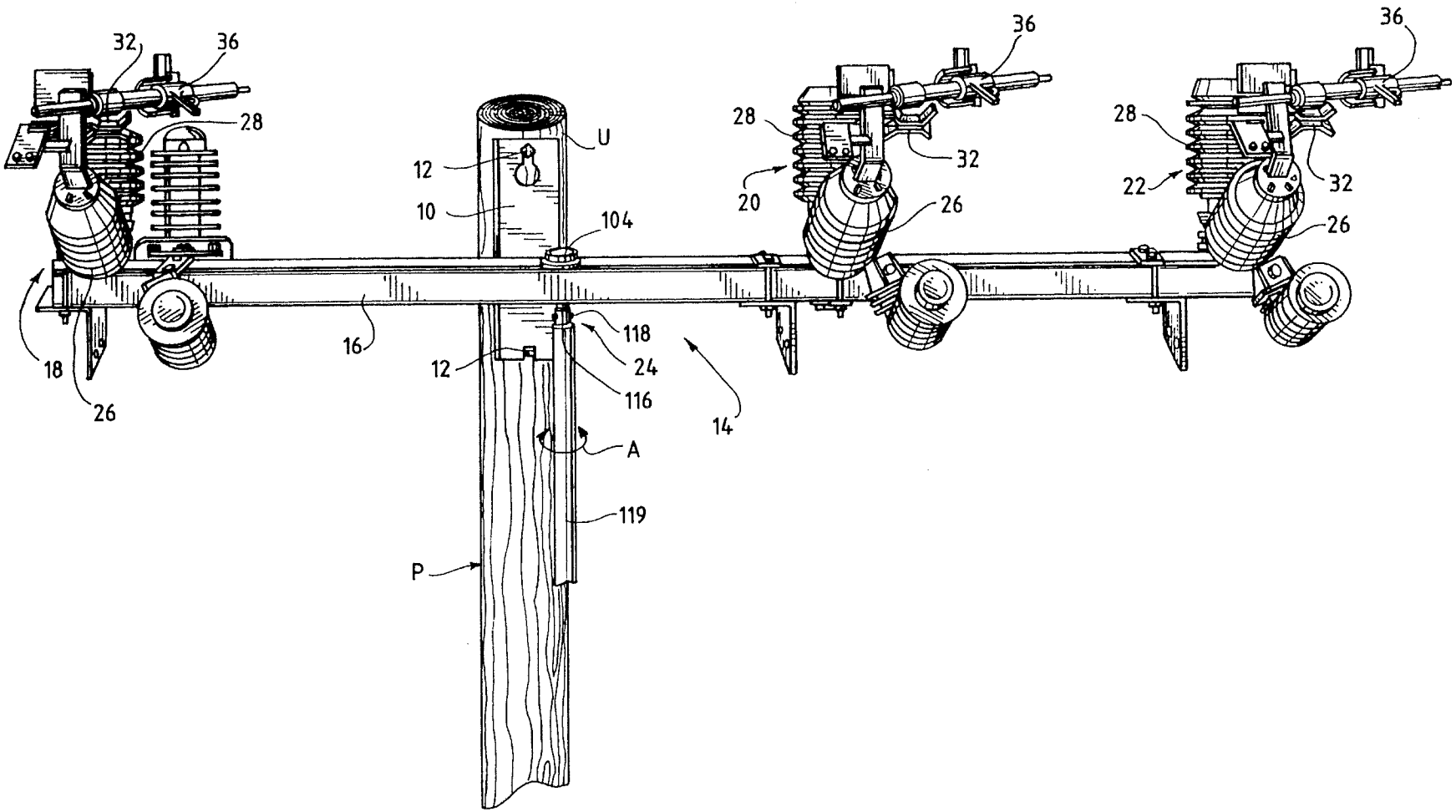
FIG. 1 is a broken, side elevational view of one embodiment of a group operated circuit disconnect apparatus incorporating the present invention with each of three disconnect switches shown in closed position.

Referring first to the embodiment of FIGS. 1–13, a utility pole "P" is shown in FIG. 1 and has an upper end "U" to which a mounting bracket 10 is attached by means of bolts 12. Mounting bracket 10 is a wide channel member having wing portions which define a shape for mating with the circular periphery of pole "P". The mounting bracket secures a circuit disconnect apparatus according to the present invention, generally designated 14, to pole "P".

Circuit disconnect apparatus 14 includes a base 16, three disconnect switches, generally designated 18, 20 and 22, respectively, mounted on base 16, and an upright control shaft means, generally designated 24, extending through base 16. As described in detail below, upright control shaft means 24 are mechanically coupled with disconnect switches 18, 20 and 22 by a transverse operating rod means 25 (FIG. 6) located within base 16 so that simultaneous operation of the three disconnect switches is achieved by actuation of upright control shaft means 24. It is a feature of the present invention that the mechanical connection between control shaft means 24 and disconnect switches 18, 20 and 22 is substantially enclosed within base 16, as described below.

Figure 2:
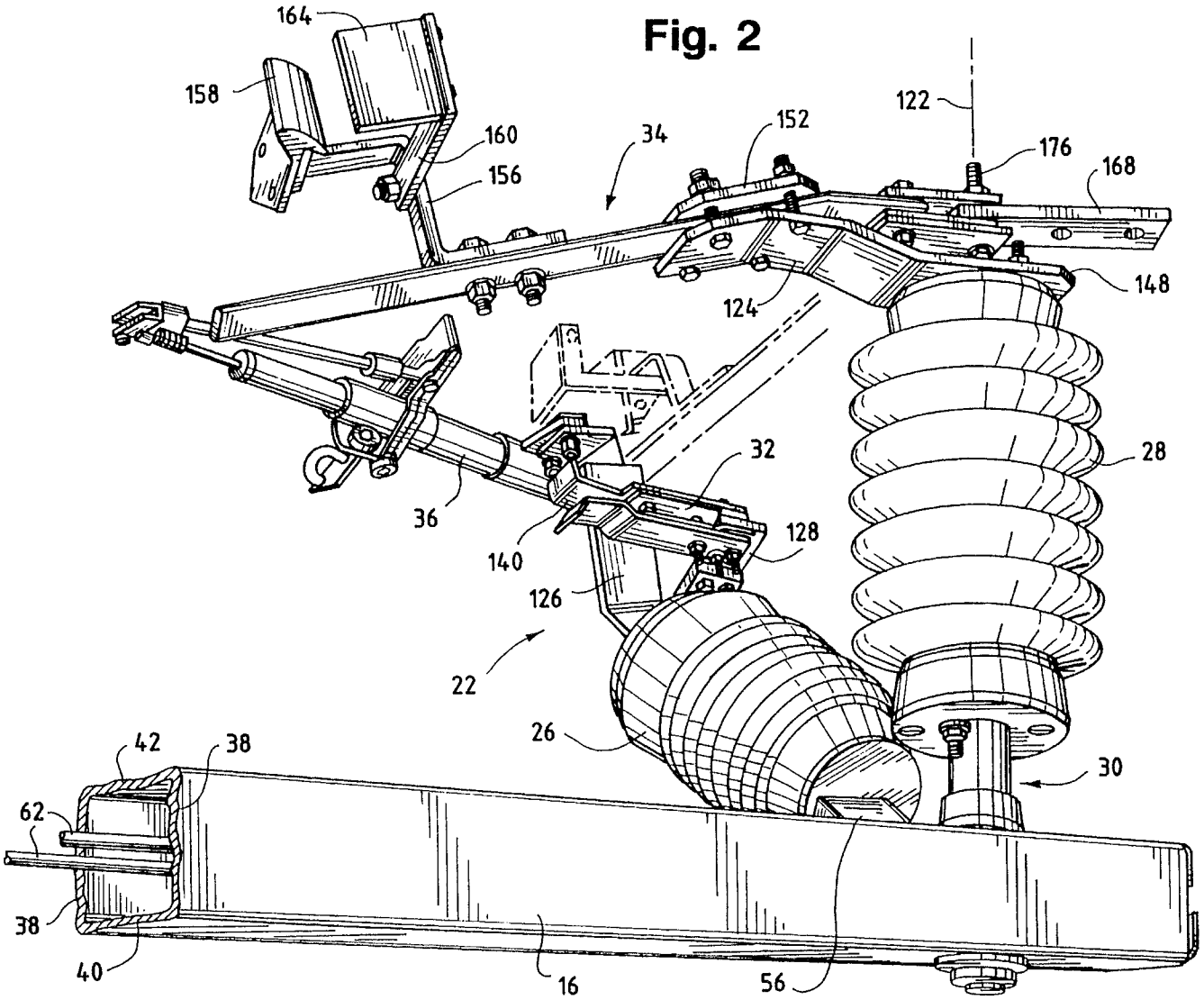
FIG. 2 is a broken, perspective view of one of the disconnect switches shown in open position.
Figure 3:
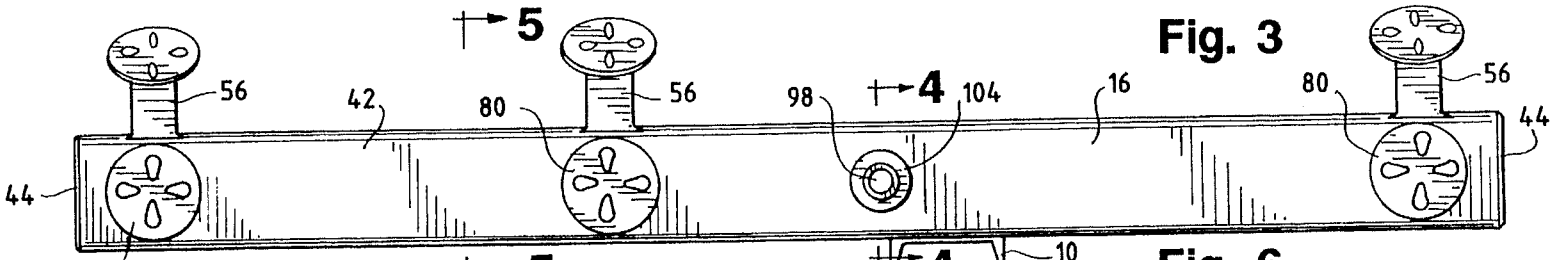
FIG. 3 is a top plan view of the base in the disconnect apparatus.
Figure 6:
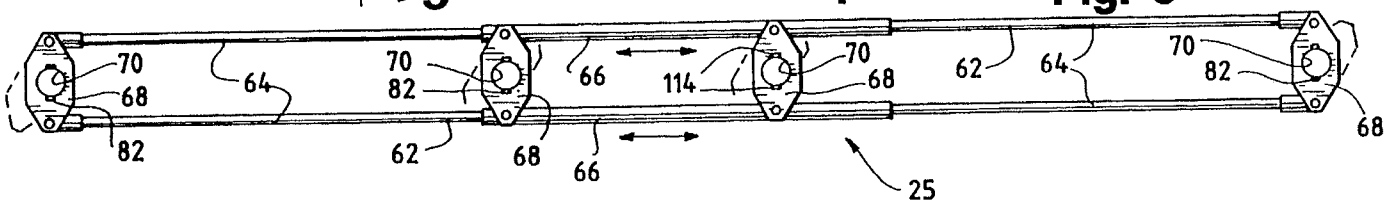
FIG. 6 is a top plan view of the transverse rod assembly shown removed from the base.
Figure 5:
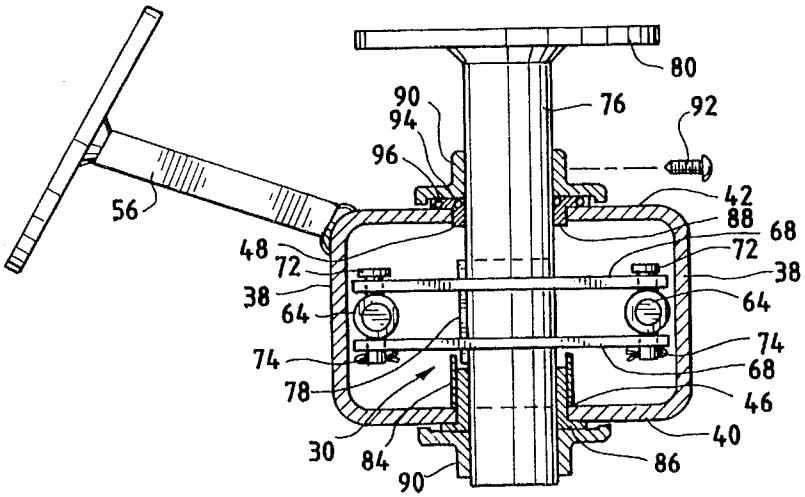
FIG. 5 is a sectional view taken along line 5—5 in FIG. 3.
Figure 4:
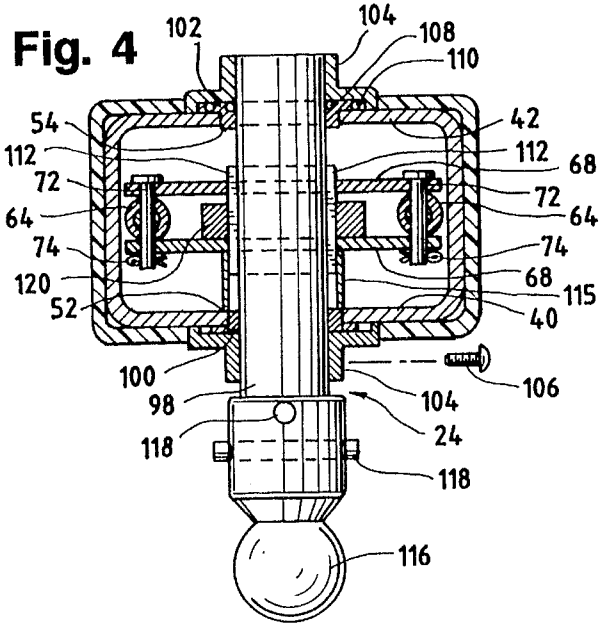
FIG. 4 is a sectional view taken along line 4—4 in FIG. 3.
Figure 7:
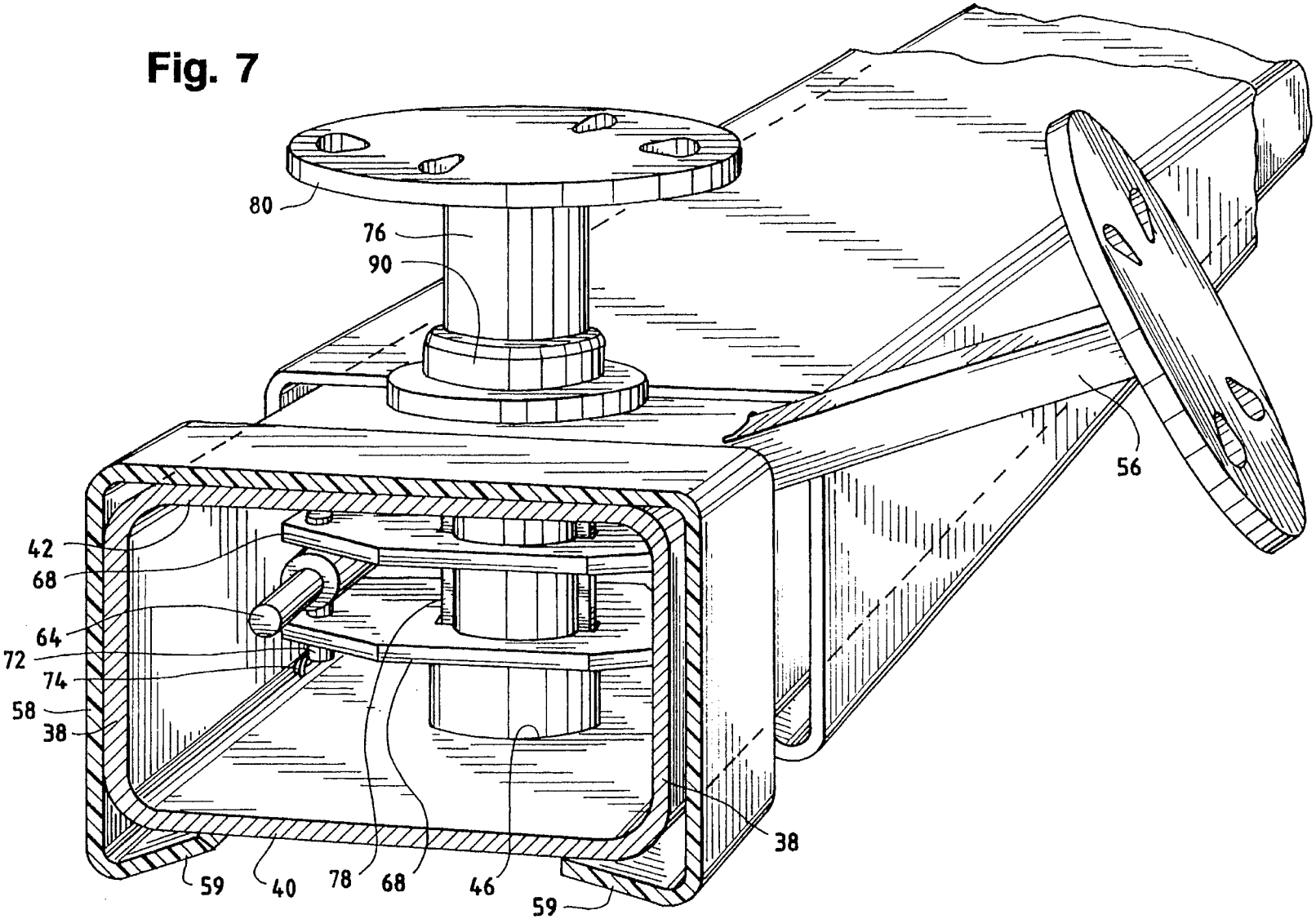
FIG. 7 is a broken, perspective view of the base.

Disconnect switches 18, 20 and 22 are substantially identical and are shown with reference to disconnect switch 22 in FIG. 2 to include a fixed insulator 26, a rotatable insulator 28 mounted on an upright operating shaft means, generally designated 30, a jaw assembly 32 mounted on fixed insulator 26, and a blade means, generally designated 34, mounted on rotatable insulator 28 and movable with insulator 28 between a normally closed position (phantom line in FIG. 2) in which blade means 34 is held in jaw assembly 32 and an open position (solid lines in FIG. 2) rotated approximately 80° from the closed position. Each of the disconnect switches is provided with a current interrupter member 36 which is operated by blade means 34 on a corresponding disconnect switch. The particular interrupter member illustrated in the drawings is that of applicant's prior U.S. Pat. No. 3,205,330, issued Sep. 7, 1965, which disclosure is incorporated herein by reference.

Structure for simultaneously operating disconnect switches 18, 20 and 22 (that is, structure for simultaneously moving blade means 34 on each of the disconnect switches between the open and closed positions thereof) when upright control shaft means 24 is actuated is shown in FIGS. 3–7.

In particular, base 16 is an elongated tube with a substantially rectangular cross-section to define a box-like housing having opposed side walls 38, a bottom wall 40 and a top wall 42. In the exemplary embodiment, base 16 is a steel tube having cross-sectional dimensions of approximately three inches by approximately five inches and a substantially uniform wall thickness of approximately three-sixteenths inches. End plates 44 attach to opposite ends of base 16 for preventing undesired access to the base interior.

Bottom wall 40 has an opening 46 aligned with a corresponding opening 48 in top wall 42 for rotatably mounting operating shaft means 30. Pairs of corresponding openings 46 and 48 are provided in base 16 at the location of each of disconnect switches 18, 20 and 22. Bottom wall 40 also has an opening 52 aligned with a corresponding opening 54 in top wall 42 for rotatably mounting upright operating shaft means 24. Three fixed insulator supports 56 extend integrally from base 16 at an acute angle relative to top wall 42 and support a fixed insulator 26 in alignment with each pair of corresponding openings 46 and 48.

A substantially non-conductive sleeve 58 (FIG. 7) covers the exterior of base 16. The sleeve is made of a material having a sufficiently high dielectric strength for insulating the base from external contact as by persons in the vicinity of the disconnect apparatus. In the exemplary embodiment, sleeve 58 is made of polycarbonate plastic having a thickness of approximately ⅛ inch. The illustrated embodiment of sleeve 58 has a plurality of individual segments which are sufficiently flexible to snap into engagement with top wall 42 and side walls 38 between adjacent electric disconnect switches 18, 20 and 22 as well as between the endmost switches and end plates 44 after the disconnect apparatus is assembled. Each sleeve segment 58 has a pair of lips 59 (See FIG. 7) for snappingly engaging bottom wall 40 of the base. The invention also contemplate the use of a one-piece sleeve wherein openings are provided for receiving upright control shaft means 24 and operating shaft means 30. A one-piece sleeve slides lengthwise over base 16 during installation.

Transverse operating rod means 25 serve to mechanically couple upright control shaft means 24 with disconnect switches 18, 20 and 22 and include a pair of parallel rod assemblies 62 axially movable (that is, movable transversely of pole "P") within base 16. Each rod assembly 62 has a pair of elongated end rods 64 joined in axial alignment with a middle rod 66. A threaded connection is provided between end rods 64 and middle rod 66 whereby the length of each rod assembly 62 is adjustable.

Rod assemblies 62 are joined together by a plurality of cranks 68 pivotally interconnected between the two rod assemblies to define a parallelogram-type linkage. Specifically, each crank 68 is a generally flat plate having a central opening 70 and pivoted at opposite ends thereof to one of the rod assemblies 62. As indicated in the Figures, cranks 68 are pivotally connected in pairs to opposite sides of rod assemblies 62 at locations corresponding to the locations of upright operating shaft means 30 and upright control shaft means 24. The cranks are connected to rod assemblies 62 by a pair of headed clevis pins 72 which extend through aligned openings in cranks 68 and rod assemblies 62 and which are secured therein by cotter pins 74.

Upright operating shaft means 30 (FIG. 5) has a generally cylindrical operating shaft 76 with a longitudinal key 78 and an integral insulator support 80. Operating shaft 76 extends through an opening 48 in top wall 42 of base 16, through aligned center openings 70 in a pair of cranks 68, and through an opening 46 in bottom wall 40 of base 16. Shaft 76 is rotatably aligned with cranks 68 so that key 78 is received in a keyway 82 at the periphery of center openings 70. A tubing segment (spacer) 84 surrounds a bottom end of shaft 76 and supports the lowermost crank 68 above bottom wall 48 to maintain engagement of key 78 with keyway 82.

Operating shafts 76 in each disconnect switch 18, 20 and 22 are supported for rotation about mutually parallel axes which lie in the same vertical plane. More particularly, operating shafts 76 are journalled in upper and lower bearings 86 and 88, respectively, which are fit into the aligned openings 46 and 48 in bottom and top walls 40 and 42, respectively, of base 16. Upper and lower bearings 86 and 88 are held in position by collars 90 secured to shaft 76 with pins 92. O-ring seals 94 and 96 surround upper bearing 88 to prevent moisture from entering base 16.

Upright control shaft means 24 (FIG. 4) has a control shaft 98 which is substantially parallel to and rotates about an axis located in the same vertical plane as the axes of operating shafts 76. Control shaft 98 is journalled in lower and upper bearings 100 and 102, respectively, which are fit into the aligned openings 52 and 54 in the bottom and top walls, respectively, of base 16 and are held in position with collars 104 secured to control shaft 98 with pins 106. O-rings 108 and 110 seat beneath upper collar 104 to prevent moisture from entering base 16.

Control shaft 98 has a pair of longitudinal keys 112 for operatively engaging keyways 114 in a pair of cranks 68. A tubing segment (spacer) 115 surrounds a bottom end of control shaft 98 and supports the lowermost crank 68 above bottom wall 40 to maintain engagement of keys 112 with keyways 114. A ball fitting 116 is detachably secured to an end of control shaft 98 by spring pins 118 for attachment of manual or motorized actuating means to the control shaft. A handle 119 is attached to the ball fitting. A cylindrical stop sleeve 120 is mounted on control shaft 98 between cranks 68 for limiting rotation of the control shaft as described below.

Simultaneous operation of disconnect switches 18, 20 and 22 is achieved by axial rotation of control shaft 98 in the direction of double-headed arrow "A". Particularly, rotation of control shaft 98 causes opposite axial translation of transverse rod assemblies 62 due to the connection established by the pairs of cranks 68 interposed between control shaft 98 and transverse rod means 25. Opposite axial translation of transverse rod assemblies 62, in turn, causes operating shafts 76 to rotate due to the connections established by the cranks 68 interposed between operating shafts 76 and transverse rod means 25. Therefore, rotatable insulators 28 and blade means 34 move alternately between closed and open positions when control shaft 98 rotates.

Transverse rod assemblies 62 move toward and away from each other when control shaft 98 and operating shafts 76 rotate. Stop sleeve 120 limits rotation of control shaft 98 by obstructing movement of transverse rod assemblies 62 toward each other when the assemblies are spaced apart a distance equal to the diameter of the stop sleeve. In the exemplary embodiment, stop sleeve 120 limits rotation of control shaft 98 to approximately eighty degrees.

The disclosed circuit disconnect apparatus 14 reduces the risk of interference with operation of disconnect switches 18, 20 and 22 by substantially enclosing transverse operating rod means 25 and the mechanical connections to operating shafts 76 and control shaft 98 within base 16. For instance, moisture accumulation and ice build-up on the moving parts is reduced since the components are shielded within the base. Seals 94, 96 and 108, 110 prevent water from draining into the housing through bearings 88 and 102 and increasing friction of the apparatus.

Further, disconnect apparatus 14 is easily insulated from external contact relatively simply by covering base 16 with plastic sleeve 58 since the mechanical connections are enclosed within the base. Such insulation greatly reduces the incidents of faults (i.e, short circuits) caused by animals, such as squirrels or large birds, which can occur when an animal bridges the air gap between the normally grounded base and the energized components of switches 18, 20 and 22 at high voltage. The insulation also affords protection to persons working in the vicinity of the disconnect switches. The disclosed disconnect apparatus advantageously provides the insulating characteristics of plastic with the structural integrity of steel base 16.

Still another feature of the enclosed linkage is that transverse operating rod means 25 and the associated mechanical connections with disconnect switches 18, 20 and 22 are concealed from view thereby providing a much desired aesthetically pleasing appearance.

Another feature of the invention involves the ease with which disconnect apparatus 14 can be assembled without requiring access holes in base 16. Minimization of openings in base 16 is desired to reduce potential sources of leakage into the housing. More particularly, the invention contemplates a method for simply and effectively assembling transverse operating rod means 25 outside base 16 and subsequently inserting operating rod means 25 through an end opening of the base and into alignment with openings 48 and 54. Specifically, stub shafts having a diameter substantially equal to the diameter of control shaft 98 and operating shafts 76 are temporarily inserted through aligned openings 52,54 and 46,48, respectively, in base 16. Cranks 68 are mounted on ends of the stub shafts which protrude from base 16, and rod assemblies 62 are axially adjusted and attached to the cranks so that the cranks are held in uniform angular alignment. The stub shafts then are removed and the transverse operating rod means is inserted lengthwise into base 16. Transverse operating rod means 25 thereby can be precisely adjusted to the exact dimensions of the base in which it is to be used to accommodate manufacturing tolerances on the dimensions between the adjacent pairs of openings in the base. Following external assembly of operating rod means 25 and insertion into base 16, operating shafts 76, bearings 86 and 88, collars 90, spacers 84 and keys 78 are assembled through each appropriate pair of openings 46, 48. Also, control shaft 98, bearings 100 and 102, collars 104, spacer 115 and keys 112 are assembled through openings 52, 54.

Referring back to FIG. 2, each disconnect switch has a fixed insulator 26 bolted to an integral support 56 on base 16 and a rotatable insulator 28 mounted on upright operating shaft means 30 for rotation about an axis 122. A blade support 124 is attached to the top of rotatable insulator 28 and is connected to blade means 34 whereby rotation of operating shaft means 30 moves blade means 34 into and out of engagement with jaw assembly 32.

Figure 8:
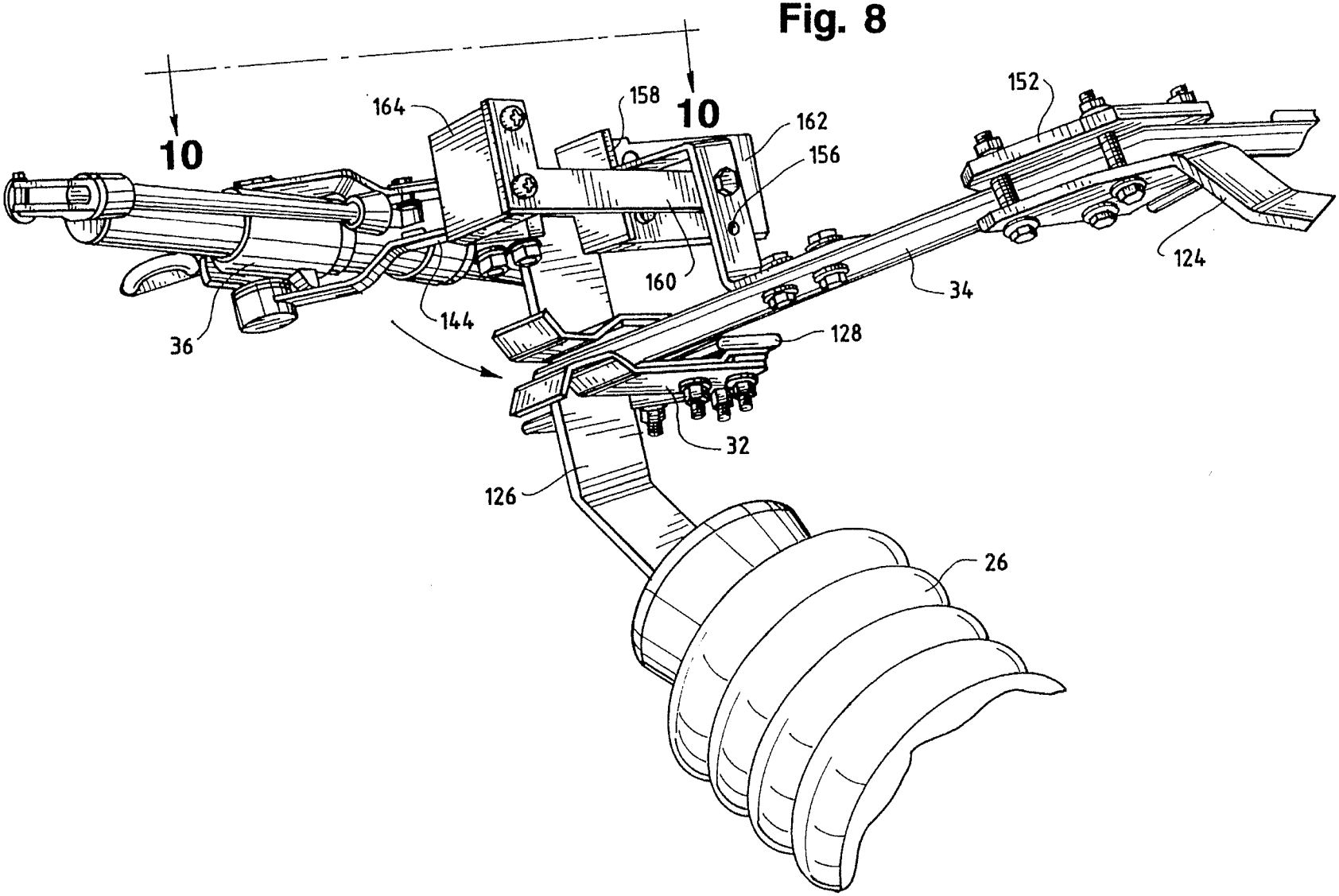
FIG. 8 is a broken, perspective view of one of the disconnect switches shown in closed position.
Figure 9:
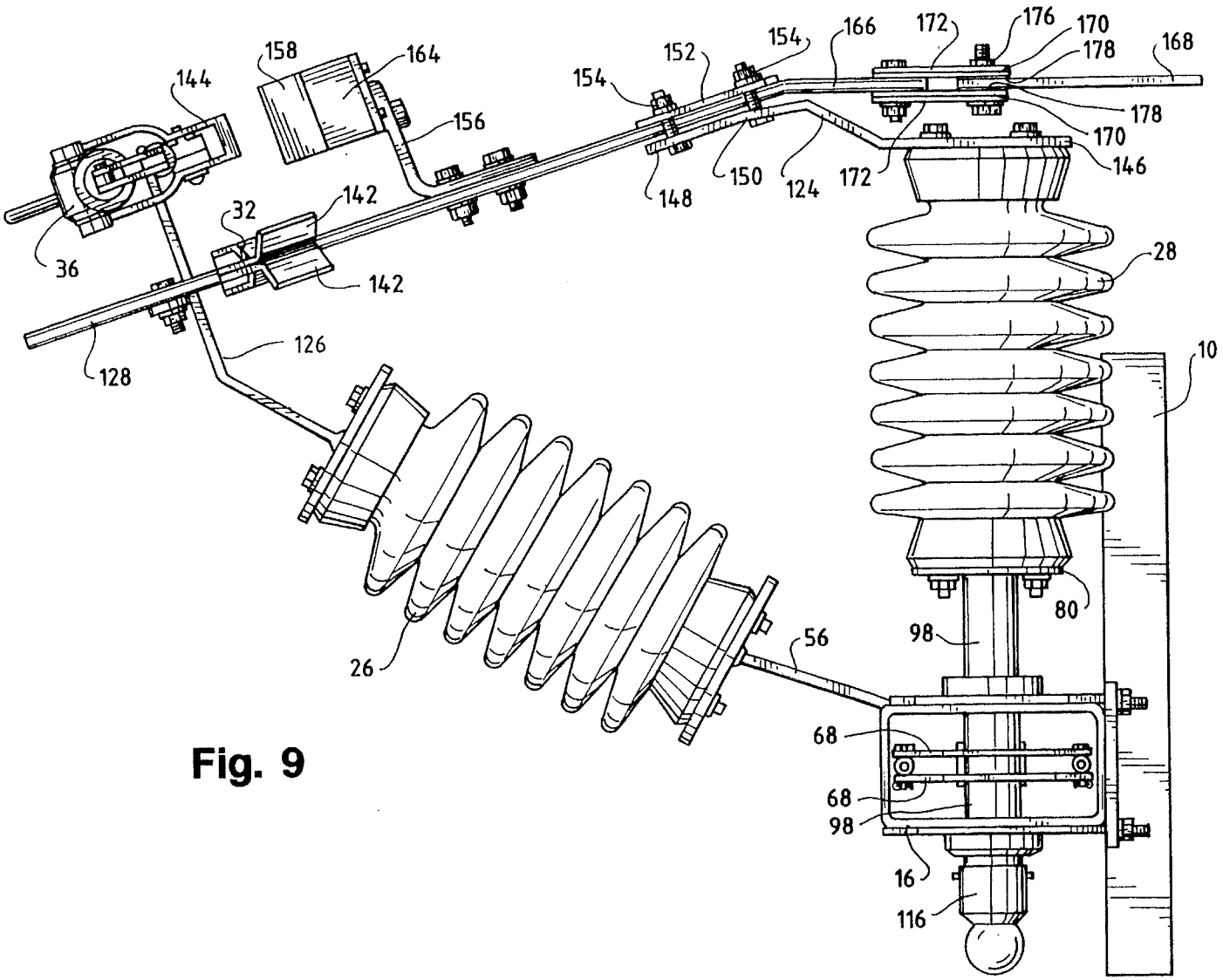
FIG. 9 is a broken, side elevational view of one of the disconnect switches shown in closed position.
Figure 11:
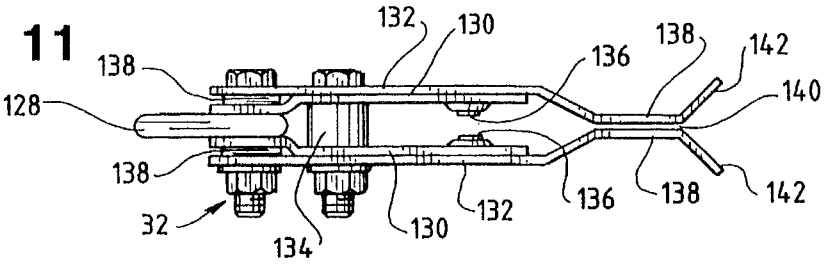
FIG. 11 is a side elevational view of the jaw terminal assembly.
Figure 10:
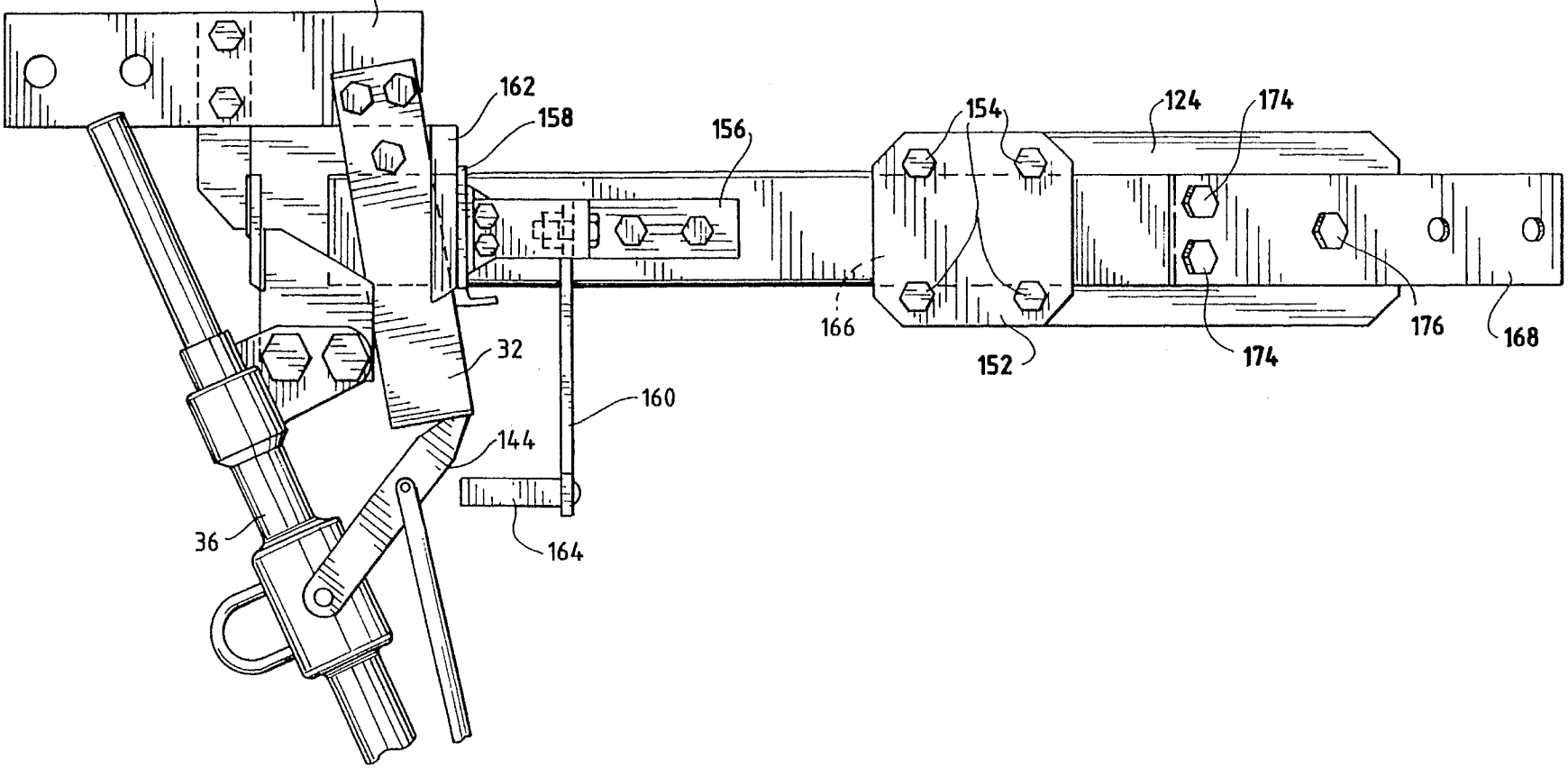
FIG. 10 is a perspective view taken along line 10—10 in FIG. 8.
Figure 12:
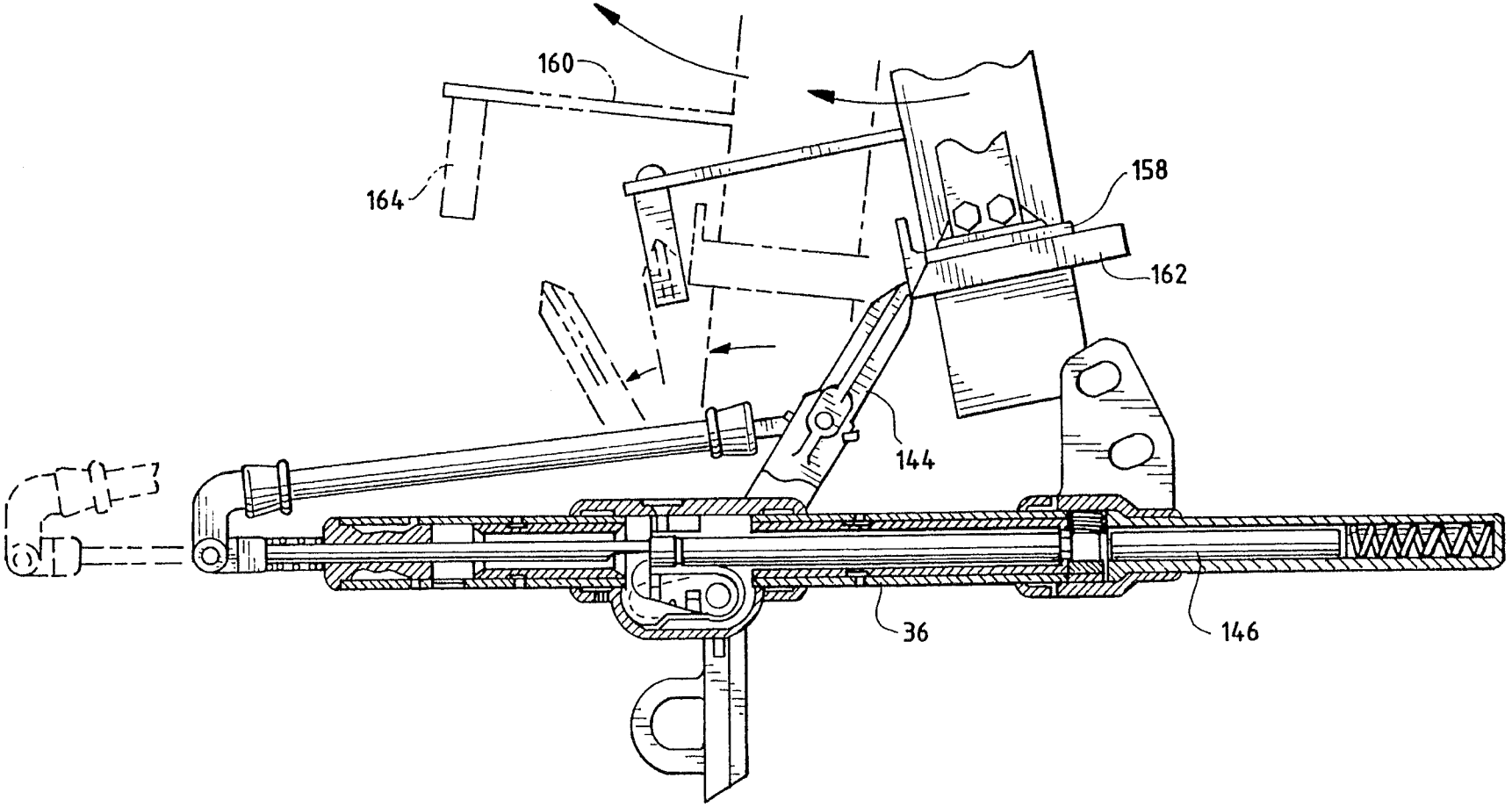
FIG. 12 is a somewhat schematic view illustrating cooperation of a switch blade and the operating lever on an interrupter member.

Referring also to FIG. 8, a support member 126 is bolted to the top of fixed insulator 26 and positions a jaw terminal 128 and current interrupter member 36.

Jaw assembly 32 is mounted on jaw terminal 128 and has a pair of copper contacts 130 (see FIG. 11) sandwiched between phosphor bronze backup springs 132 and opposite sides of a spacer 134. Silver rivets 136 are soldered to inwardly facing surfaces of jaw contacts 130 to make electrical contact with blade means 34 when the blade means engages jaw assembly 32. Spacers 138 are located between trailing ends of jaw contacts 130 and backup springs 132 whereby forward portions of the backup springs are biased toward each other to assist in holding blade means 34 between jaw contacts 130.

Notably, backup springs 132 extend forwardly of jaw contacts 130 and converge toward each other to define a pair of auxiliary contacts 138 with an intermediate gap 140 for initially receiving blade means 34 when the blade means moves into engagement with jaw assembly 32. Terminal ends 142 of auxiliary contacts 138 diverge from gap 140 to facilitate directing blade means 34 into the gap when a disconnect switch closes. Auxiliary contacts 138 defined by backup springs 132 are biased toward each other due to the resilience and geometry of the contacts and thus act as an auxiliary spring for applying clamping force to assist retain blade means 34 in gap 140.

As stated above, details of current interrupter 36 are incorporated herein by reference to applicant's prior U.S. Pat. No. 3,205,330, issued Sep. 7, 1965, wherein it is disclosed generally that current interrupter 36 has an operating lever 144 which rotates between a latched position (solid lines in FIG. 12) for holding a spring-biased plunger 146 in the current interrupter in electrical contact with jaw terminal 128 and operating lever 144 and an open position (phantom lines in FIG. 12) wherein plunger 146 shifts within current interrupter 36 to electrically disconnect jaw terminal 128 from operating lever 144.

Blade support 124 has a first end portion 146 bolted to rotatable insulator 28 and a bent second end portion having a pair of oppositely angled segments 148 and 150. Blade means 34 is secured between blade support segments 148 and 150 and a blade clamp 152 by a plurality of suitable fasteners 154. Selective tightening of fasteners 154 adjusts the angle of blade means 34 relative to fixed insulator 26 to align the blade means with gap 140.

An upright contactor support 156 (see FIG. 10) is bolted to blade means 34 and mounts a conductive blade end 158 and an elongated bumper arm 160. A substantially rectangular nylon bar 162 seats on the blade end 158. A nylon bumper 164 is attached to the end of bumper arm 160.

Blade means 34 has a bent end 166 (FIGS. 9 and 10) conductively connected to a hinge terminal 168 by a pair of hinge contact plates 170 which are flanked by a pair of hinge back-up plates 172. Hinge contact plates 170 and hinge back-up plates 172 are secured to blade end 166 with a pair of fasteners 174. A hinge terminal bolt 176 secures hinge contact plates 170 and hinge back-up plates 172 to hinge terminal 168. Hinge terminal bolt 176 is substantially aligned with axis 122. An electrically conductive silver washer 178 is located between each side of hinge terminal 168 and a respective one of the hinge contact plates 170.

Operation of a disconnect switch is summarized as follows. When blade means 34 is in the closed position shown in FIG. 8, wherein blade means 34 is gripped between jaw contacts 130, a high voltage circuit between jaw terminal 128 and hinge terminal 168 is closed through jaw assembly 32 and blade means 34. Operating lever 144 of current interrupter 36 is located between blade end 158 and bumper 164 when a switch is closed and current interrupter 36 is in a latched position.

Blade means 34 moves away from jaw assembly 32 and gradually disengages jaw contacts 130 when a switch opens. Due to the dimensional relationship between auxiliary contacts 138 and the geometry of contactor support 156, blade end 158 engages operating lever 144 before blade means 34 disengage jaw assembly 32. A parallel circuit between jaw terminal 128 and hinge terminal 168 thus is closed through current interrupter 36, operating lever 144, blade end 158, contactor support 156 and blade means 34 when blade end 158 engages operating lever 144.

As blade means 34 continues to move to a fully open position (see FIG. 12) and out of engagement with auxiliary contacts 138, blade end 158 remains in sliding contact with lever 144 so that the circuit remains closed through current interrupter 36 until blade means 34 has sufficient clearance from contact assembly 32 that no arc can be pulled between blade means 34 and contact assembly 32. When blade means 34 is sufficiently spaced from contact assembly 32, blade means 34 unlatches current interrupter 36 and opens the circuit.

The circuit is closed when blade means 34 is moved toward the closed position thereof and into engagement with auxiliary contacts 138 and contacts 130. As blade means 34 initially is moved toward the closed position, nylon bar 162 on blade end 158 contacts operating lever 144 on current interrupter 136 and drives the operating lever into the latched position. Due to relatively high dielectric strength of bar 162 the circuit is not made until blade means 34 moves within arc striking distance of auxiliary contacts 138. Bumper 164 restrains operating lever 144 from rebounding to a position where it will be engaged by blade end 158 when a disconnect switch opens.

It is a feature of the invention that phosphor bronze back-up springs 132 define auxiliary contacts 138 for (1) maintaining electrical contact with blade means 34 as the blade means move from the fully closed position to the point at which contact is made with operating lever 144 of interrupter member 36, and (2) making the circuit when blade means 34 move from the open position to the closed position thereof. Due to the high voltages (ranging from 7.5 to 34.5 KV) of electric power distribution systems in which the present disconnect apparatus 14 is used, pre-arcing can, in some instances, cause severe damage or even destroy contacts prior to engagement. Tests have established that the disconnect apparatus 14 can withstand, without significant damage, a large number of closings at normal current levels. Tests have also shown that the auxiliary contacts 38 can withstand currents up to approximately 20,000 amps, such as when a switch is closed into a faulted circuit. Since contacts 38 provide parallel paths, fault current flows in the same direction through the contacts. Interaction of the resulting magnetic fields produces a force tending to draw the contacts together. The force increases contact pressure between auxiliary contacts 38 and blade means 34 and minimizes arc damage to the components. Moreover, damage caused by pre-arcing tends to occur on a portion of blade means 34 spaced from the location where rivet contacts 136 engage blade means 34 so that a switch remains capable of carrying its full rated load current even after having closed in on substantial fault currents.

FIGS. 14 and 15 show an alternate embodiment of a circuit disconnect apparatus, generally designated 14', which is substantially identical to disconnect apparatus 14 (FIG. 1) except for the symmetrical mounting of the apparatus in FIGS. 14 and 15. Therefore, like numerals have been applied in FIGS. 14 and 15 corresponding to like components described above.

More particularly, circuit disconnect apparatus 14' again includes base 16 mounting the three disconnect switches 18, 20 and 22. Each switch again includes a fixed insulator 26 and a rotatable insulator 28 along with current interrupter members 36. The apparatus is mounted to the upper end of pole "P" by mounting bracket 10. Handle 119 (FIG. 14) is attached to ball fitting 116 (FIG. 15) for operating the apparatus as described above in relation to FIG. 1. Actually, handle 119 extends through an articulated joint 180 (FIG. 14) to handle sections which extend all the way down the pole to a handle section 182 at an elevation to be grasped by an operator and rotated in the direction of double-headed arrow "A" similar to that described in relation to the embodiment of FIG. 1.

It can be seen that circuit disconnect apparatus 14' in FIGS. 14 and 15 is mounted such that the center disconnect switch 20 is substantially on line with the axis of pole "P". Therefore, handle 119 is connected through ball fitting 116 directly to the operating shaft of the center disconnect switch. Consequently, control shaft 98 (FIG. 4) of the embodiment of FIGS. 1–13 is eliminated. In other words, operation is effected directly through the operating shaft means of the center disconnect switch which, in turn, operates the other "outboard" two disconnect switches through the same mechanism described above in relation to the embodiment of FIGS. 1–13, including the transverse operating rod means 25 shown in FIG. 6, and including rods 64 and 66 and cranks 68 interconnecting the three control shafts of the three disconnect switches, the transverse operating rod means 25 again all being mounted within base 16 in FIGS. 14 and 15.

FIGS. 16–22 show still another embodiment of the invention wherein the base 16 (FIGS. 16–18) of a circuit disconnect apparatus is mounted by a pair of brackets 190 (FIG. 16) to utility pole "P" with fasteners 192 as seen in FIG. 17. In this embodiment, the base and the circuit disconnect apparatus are mounted in a vertical orientation generally parallel to and alongside a length of the pole at the upper end "U" (FIG. 16) thereof.

Figure 18:
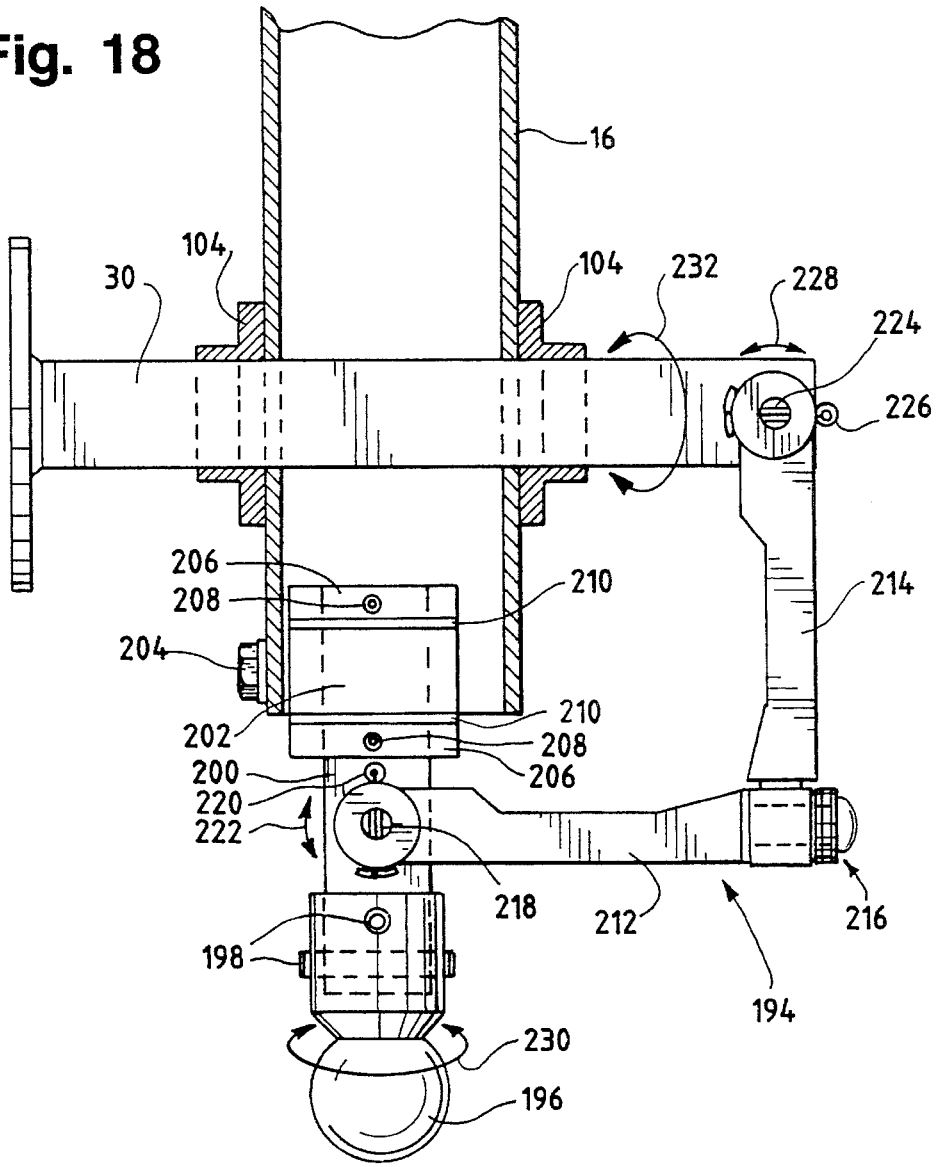
FIG. 18 is a partial section through the lower end of the apparatus of FIG. 16, on an enlarged scale, to show the details of the rotary operating mechanism.

In the embodiment of FIGS. 16–22, the inventive modification is in a rotary operating mechanism, generally designated 194, mounted at the lower end of the circuit disconnect apparatus. Therefore, the details of the disconnect switches, current interrupters, etc. have been omitted to simplify the illustration and the following description. Suffice it to say, as in the previous embodiments, three operating shafts 30 again have integral disk-shaped supports 80 for the respective disconnect switches, similar to the depiction in FIG. 3. The operating shafts extend through base 16 as shown in FIG. 18. The operating shafts are rotatably interconnected by a transverse operating rod means substantially identical to operating rod means 25 in FIG. 6, including rods 64 and cranks 68, so that the operating shafts of the disconnect switches are conjointly rotatable in response to rotating one of the operating shafts. Therefore, it can be understood that by rotating the operating shaft 30 for the lower disconnect switch by rotary operating mechanism 194 in FIG. 16, all of the operating shafts for the other disconnect switches will be rotated by the transverse operating rod means within base 16.

Referring to FIG. 18 in conjunction with FIG. 16, rotary operating mechanism 194 includes a ball fitting 196 fixed by spring pins 198 to the bottom end of a control shaft 200. The control shaft extends through a block 202 mounted by a pair of bolts 204 within the open lower end of base 16. A pair of collars 206 are fixed by spring pins 208 to control shaft 200 on opposite sides of block 202. A pair of journal bearings 210 are sandwiched between collars 206 and the opposite sides of block 202. With this mounting arrangement, control shaft 200 is free to rotate within block 202.

Rotary operating mechanism 194 further includes a horizontal crank arm 212 connected to a vertical crank arm 214 by means of a universal joint 216. Horizontal crank arm 212 is connected to control shaft 200 by a pivot pin 218 and a cotter pin 220 so that the horizontal crank arm can pivot relative to the control shaft as indicated by double-headed arrow 222. Similarly, vertical crank arm 214 is connected to operating shaft 30 of the lower disconnect switch by a pivot pin 224 and a cotter pin 226 so that the vertical crank arm can pivot relative to the operating shaft as indicated by double-headed arrow 228.

With the general structure described above in relation to rotary operating mechanism 194 in FIG. 18, as ball fitting 196 and control shaft 200 are rotated in the direction of double-headed arrow 230, operating shaft 30 is rotated in the direction of double-headed arrow 232. Of course, a handle, like handle 119 (FIG. 1), is attached to ball fitting 196. The transference of rotary motion from control shaft 200 to operating shaft 30 is afforded by the pivoting articulation of crank arms 212 and 214 as described above. The crank arms are shown in FIG. 18 in a generally centrally disposed or neutral condition. In actual practice, the range of rotary motion is approximately 40° away from the neutral position in both opposite directions (i.e. into and out of the plane of the drawing).

Figure 19:
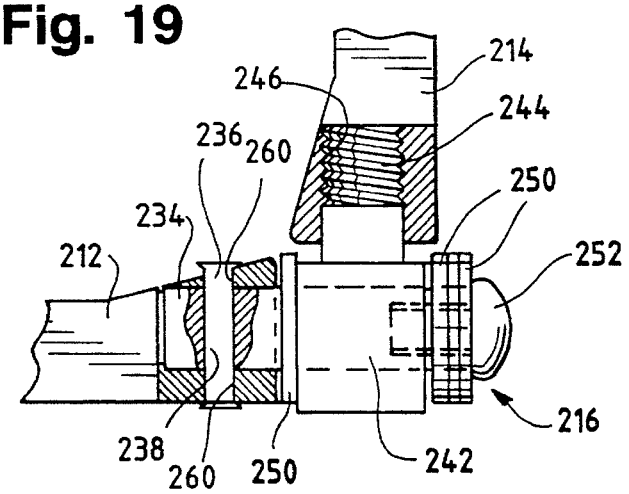
FIG. 19 is a section through the adjacent ends of the crank arms and the universal joint of the rotary operating mechanism in FIG. 18.

FIG. 19 shows universal joint 216 in greater detail. This illustration will be described in conjunction with FIGS. 22 and 23. More particularly, a pivot post 234 is fixed to the distal end of horizontal crank arm 212 by a pin 236. The pin extends through a hole 238 in pivot post 234. The outer or distal end of the pivot post has an internally threaded bore 240 as seen best in FIG. 22.

Universal joint 216 also has a swivel 242 that includes an externally threaded shank 244 that is threaded into an internally threaded bore 246 within the distal end of vertical crank arm 214. As best seen in FIG. 23, swivel 242 has an elongated hole 248 into which pivot post 234 extends. Hole 244 is elongated so that it is longer than the diameter of pivot post 234 so that there is lost motion or "play" between the pivot post and the swivel to allow articulation between the crank arms at universal joint 16. Lastly, washers 250 are provided about pivot post 234 on opposite sides of swivel 242, and the entire assembly is held together by a bolt 252 (FIG. 19) threaded into internally threaded bore 240 of pivot post 234.

Crank arms 212 and 214 are substantially identical, and one of which is shown in FIGS. 20 and 21. More particularly, one end of each crank arm is formed generally as a yoke defining a pair of legs 254 which straddle opposite sides of either control shaft 200 or operating shaft 30. It can be seen that each leg has a hole 256 for the passage therethrough of pivot pin 218 (or pivot pin 224). In addition, a transverse through hole 258 is provided in leg 254 for receiving cotter pin 220 (or cotter pin 226). The opposite end of crank arm 212 is provided with a reamed hole for receiving pivot post 234, which is pinned to arm 212 by pin 236. Crank arm 214 (FIGS. 20 and 21) is provided with an internally threaded bore 246 for receiving swivel 242. The aforementioned threads allow swivel 242 to rotate about its axis with respect to arm 214, to accommodate the change in angular relationship of arms 212 and 214 during switch operation.

Lastly, FIG. 24 shows block 202 (FIG. 18) through which control shaft 200 extends. The block has a through hole 264 for receiving the control shaft, and a pair of internally threaded bores 266 for receiving bolts 204 (FIG. 18).

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A group operated electric circuit disconnect apparatus for a plurality of overhead electric power distribution lines carried on poles, comprising:

a box-like elongated housing;

means for mounting the elongated housing to a pole;

at least two disconnect switches mounted to the housing;

a plurality of operating shafts each journalled for rotation about a respective first axis fixed relative to said elongated housing and connected to one of said disconnect switches so that rotation of said operating shafts about said first axes moves said disconnect switches between open and closed positions;

a control shaft journalled for rotation about a second axis fixed relative to said elongated housing; and a pair of operating rod means extending transversely of the pole enclosed entirely within the housing for defining a mechanical connection between the control shaft and opposite sides of the operating shafts so that rotation of the control shaft about said second axis causes rotation of the operating shafts about said first axes.

2. The disconnect apparatus of claim 1 in which each operating rod means comprises an elongated rod longitudinally movable within the elongated housing, and means pivotally connecting the operating shafts and the control shaft to each said elongated rod whereby rotation of said control shaft about said second axis causes longitudinal movement of each said elongated rod and rotation of said operating shafts about said first axes.

3. The disconnect apparatus of claim 1, including means for adjusting the length of each said rod.

4. The disconnect apparatus of claim 1 in which said first axes are substantially parallel to and coplanar with each other.

5. The disconnect apparatus of claim 4 in which said first axes are substantially parallel to and coplanar with said second axis.

6. The disconnect apparatus of claim 1 wherein stop means are provided within the housing for limiting rotation of the control shaft.

7. The disconnect apparatus of claim 1 in which the housing is made of metal and has a substantially non-conductive cover.

8. The disconnect apparatus of claim 1 in which the elongated housing has top and bottom walls and side walls, said shafts being journalled in said top and bottom walls, and seal means surrounding the shafts at the top wall for preventing moisture from entering the housing.

9. The disconnect apparatus of claim 1 in which at least one of said disconnect switches has a pair of spaced apart terminals, a conductive blade pivoted to one of said terminals, and jaw means conductively associated with the other of said terminals for selectively receiving said conductive blade to alternately connect and disconnect said terminals, said jaw means comprising a first pair of electrical contacts for receiving said conductive blade therebetween, backup springs adjacent outer surfaces of said first contacts for urging said first contacts toward each other, and a second pair of electrical contacts integral with said backup springs for making electrical contact with said conductive blade without the blade making electrical contact with said first pair of contacts.

10. The disconnect apparatus of claim 9 in which said second pair of contacts are made of phosphor bronze.

11. The disconnect apparatus of claim 1 wherein said control shaft comprises one of said operating shafts.

12. The disconnect apparatus of claim 11 wherein said control shaft and said one operating shaft are located substantially on the axis of the pole.

13. A group operated electric circuit disconnect apparatus for a plurality of overhead electric power distribution lines carried on poles, comprising:

a base;

means for mounting the base to a pole; and at least two disconnect switches mounted on the base, at least one of said disconnect switches having a pair of spaced apart terminals, a conductive blade pivoted to one of said terminals, and jaw means conductively associated with the other of said terminals for selectively receiving said conductive blade to alternately connect and disconnect said terminals, said jaw means comprising a first pair of electrical contacts for receiving said conductive blade therebetween, backup springs adjacent outer surfaces of said first contacts for urging said first contacts toward each other, and a second pair of electrical contacts for making electrical contact with said conductive blade without the blade making electrical contact with said first pair of contacts.

14. The disconnect apparatus of claim 13 in which said second pair of contacts engage said switch blade at a location spaced from a location where said first pair of contacts engage said switch blade whereby arcing between said second pair of contacts and said switch blade does not prevent a conduction of current between said first pair of contacts and said switch blade.

15. The disconnect apparatus of claim 13 in which said second pair of contacts are integral with said backup springs.

16. The disconnect apparatus of claim 13 in which said second pair of contacts are made of phosphor bronze.

17. The disconnect apparatus of claim 13 wherein said base is a box-like housing and including a plurality of operating shafts each journalled for rotation about a respective first axis fixed relative to said housing and connected to one of said disconnect switches so that rotation of said operating shafts about said first axes moves said disconnect switches between open and closed positions;

a control shaft journalled for rotation about a second axis fixed relative to said housing; and operating rod means for defining a mechanical connection between the control shaft and the operating shafts so that rotation of the control shaft about said second axis causes rotation of the operating shafts about said first axes.

18. The disconnect apparatus of claim 17 wherein said operating means extend transversely of the pole and are enclosed entirely within the housing.

19. The disconnect apparatus of claim 18 in which the housing is elongated and the operating rod means comprises an elongated rod longitudinally movable within the elongated housing, and including means pivotally connecting the operating shafts and the control shaft to said elongated rod whereby rotation of said control shaft about said second axis causes longitudinal movement of said elongated rod and rotation of said operating shafts about said first axes.

20. The disconnect apparatus of claim 17 wherein said control shaft comprises one of said operating shafts.

21. The disconnect apparatus of claim 12 wherein said control shaft and said one operating shaft are located substantially on the axis of the pole.

22. In a group operated electric circuit disconnect apparatus for overhead electric power distribution lines carried on poles, the apparatus having a plurality of disconnect switches each including an exposed rotatable element mounting a switch blade and a fixed dement having a contact engageable with the switch blade, and a shaft operatively connected to said disconnect switch so that axial rotation of said shaft rotates the switch blade to open and close the disconnect switch, and transverse operating rod means with a mechanical connection with each said shaft so that axial translation of said operating rod means causes axial rotation of the shafts, wherein the improvement comprises:

a base mountable on a pole, the base having a top wall for supporting the shafts for rotation about mutually parallel spaced apart axes located in a common vertical plane, the base also having bottom and side walls to define a box-like elongated housing for substantially enclosing the operating rod means and mechanical connection.

23. The base of claim 22 in which the housing has a substantially non-conductive cover for insulating said operating rod means and said mechanical connection from external contact.

24. The base of claim 22 in which the rotatable element of each disconnect switch is supported on one of the shafts, and including support means on the base inclined relative to the shafts for supporting the fixed element of a respective disconnect switch at an acute angle relative to the rotatable element of the respective disconnect switch.

25. The disconnect apparatus of claim 22, including a terminal contact and means mounting the terminal contact along the axis of the rotatable element for electrically connecting a power line to said terminal so that the contact remains substantially stationary when the switch blade rotates.

26. A method of assembling a group operated electric circuit disconnect apparatus for use with overhead electric power distribution lines carried on poles, the apparatus having a plurality of disconnect switches, a plurality of shafts journalled on an elongated box-like housing and operatively connected to the disconnect switches so that axial rotation of the shafts opens and closes the disconnect switches, and operating rod means with a mechanical connection inside the elongated housing between the shafts and the operating rod means so that axial translation of the operating rod means causes axial rotation of the upright shafts, comprising the steps of:

providing a plurality of spaced apart through openings in said elongated housing;

inserting stub shaft means into said openings during assembly so that the stub shaft means extend outside the housing;

positioning said operating rod means adjacent said housing exterior;

providing a plurality of links for operatively connecting the shafts to the operating rod means, the links having an opening for receiving the shafts in a predetermined angular relationship therewith;

aligning the links in said predetermined angular relationship with the stub shaft means outside the housing and pivotally connecting said aligned links to the operating rod means;

removing said stub shaft means from the housing and link openings;

inserting said operating rod means and links pivoted thereto lengthwise into the elongated housing so that the link openings are aligned with the housing openings; and inserting said shafts through said housing openings and said link openings to operatively connect the upright shafts and the operating rod means.

27. The method of claim 26 in which the disconnect apparatus has an operating shaft with a mechanical connection inside the housing to said operating rod means so that axial rotation of the operating shaft causes axial translation of the operating rod means, the method comprising the steps of:

providing one of said through openings in said housing at the location of said operating shaft;

providing a link for operatively connecting the operating shaft to the operating rod means, said link having an opening for receiving the operating shaft in a predetermined angular relationship therewith; and aligning the link in said predetermined angular relationship with the stub shaft means outside the housing and pivotally connecting said aligned link to the operating rod means.

28. The method of claim 26 in which the operating rod means is lengthwise adjustable, the method comprising the step of adjusting the length of the operating rod means while said operating rods means are outside the housing so that the locations at which said links pivotally connect to the operating rod means are longitudinally aligned with the stub shafts during assembly.

29. A group operated electric circuit disconnect apparatus for a plurality of overhead electric power distribution lines carried on poles, comprising:

an elongated base;

means for mounting the base to a pole;

at least two disconnect switches;

at least two operating shafts each journalled on the base for rotation about an axis generally transversely of the base and connected to one of the disconnect switches so that rotation of the operating shafts about their axes moves the disconnect switches between open and closed positions;

a control shaft journalled on the base near one end thereof for rotation about an axis generally coaxially of the base;

an articulated rotary operating mechanism operatively connected between the control shaft and one of the operating shafts for transmitting rotary motion from the control shaft to the one operating shaft; and means interconnecting the operating shafts for effecting conjoint rotation thereof.

30. The group operated electric circuit disconnect apparatus of claim 29 wherein said articulated rotary operating mechanism includes a first crank arm connected to the control shaft and projecting transversely therefrom to a distal end of the first crank arm, a second crank arm connected to the one operating shaft and projecting transversely therefrom to a distal end of the second crank arm, and a universal joint operatively connecting the distal ends of the crank arm.

31. The group operated electric circuit disconnect apparatus of claim 30 wherein each crank arm is connected to its respective shaft by pivot means which allows the crank arm to pivot relative to its respective shaft about an axis extending transversely through the crank arm and shaft.

32. The group operated electric circuit disconnect apparatus of claim 30 wherein said universal joint comprises a swivel member mounted on the distal end of one of the crank arms for swivelling about a swivel axis coaxially of the one crank arm, the swivel member having an elongated slot therein extending transversely of the swivel axis, and a post member projecting coaxially from the distal end of the other crank arm and into said slot.

33. The group operated electric circuit disconnect apparatus of claim 32 wherein each crank arm is connected to its respective shaft by pivot means which allows the crank arm to pivot relative to its respective shaft about an axis extending transversely through the crank arm and shaft.

34. The group operated electric circuit disconnect apparatus of claim 33 wherein said base is mounted in a vertical orientation alongside the pole, and said control shaft projects from a bottom end of the elongated base.

35. The group operated electric circuit disconnect apparatus of claim 34 wherein said one operating shaft and its respective disconnect switch are located near the bottom end of the base.

36. The group operated electric circuit disconnect apparatus of claim 29 wherein said base is mounted in a vertical orientation alongside the pole, and said control shaft projects from a bottom end of the elongated base.

37. The group operated electric circuit disconnect apparatus of claim 36 wherein said one operating shaft and its respective disconnect switch are located near the bottom end of the base.

* * * * *